US005621804A

United States Patent [19]

Beppu

[11] Patent Number: 5,621,804

[45] Date of Patent: Apr. 15, 1997

[54] COMPOSITE LOUDSPEAKER APPARATUS AND DRIVING METHOD THEREOF

[75] Inventor: Satoshi Beppu, Nagaokakyo, Japan

[73] Assignee: Mitsubishi Denki Kabushiki Kaisha, Tokyo, Japan

[21] Appl. No.: 688,219

[22] Filed: Jul. 29, 1996

Related U.S. Application Data

[63] Continuation of Ser. No. 346,914, Nov. 23, 1994, abandoned.

[30] Foreign Application Priority Data

Dec. 28, 1993 [JP] Japan ..... 5-334395

[51] Int. Cl.$^6$ ..... H04R 1/02

[52] U.S. Cl. ..... 381/90; 381/159; 381/188; 181/145

[58] Field of Search ..... 381/159, 154, 381/153, 86, 24, 90, 88, 188, 205, 182, 186, 185; 181/145, 144, 148, 199

[56] References Cited

U.S. PATENT DOCUMENTS 5,147,986 9/1992 Cockrum et al. .
5,222,145 6/1993 Draffen .

FOREIGN PATENT DOCUMENTS

624047A1 11/1994 European Pat. Off. .
2663181 12/1991 France ..... 381/159
2277400 11/1990 Japan ..... 381/24
4192795 7/1992 Japan ..... 381/159
1420714 1/1976 United Kingdom .
1500711 2/1978 United Kingdom .
2256344 12/1992 United Kingdom .
1018386 1/1993 United Kingdom .

OTHER PUBLICATIONS

Translation of cited reference 2663181 by Lann. Dec. 1991.
Translation of cited reference 4192795 by Koizumi. Jul. 1992.
Selbstbau: Alto–Boxen In: Radio Fernsehen Elektronik, 1993 Nr. 8, pp. 30–31.
Anzeige der Fa. Miller & Kreisel Sound Corporation In: Audio, 1993, Nr. 1, p. 109.
Anzeige der Fa. Bose In: Audio, 1989, Nr. 1, pp. 92–93.

*Primary Examiner*—Curtis Kuntz
*Assistant Examiner*—Ping W. Lee

[57] ABSTRACT

A composite loudspeaker apparatus including a cabinet which has a first air chamber and a second air chamber having a sound port, a drone cone or a resonance duct, adjacent to each other, wherein the first air chamber has a first loudspeaker driven by the audio signal of one of the left (L) and right (R) channels, and the second air chamber has a second loudspeaker driven by the low frequency component of the synthesized audio signal of the L and R channels mounted therein. The apparatus has another cabinet wherein a third loudspeaker driven by the audio signal of the other of the L and R channels is mounted therein. Another cabinet has a sound port, a drone cone or a resonance duct.

14 Claims, 18 Drawing Sheets

COMPOSITE LOUDSPEAKER APPARATUS AND DRIVING METHOD THEREOF

This application is a continuation, of application Ser. No. 08/346,914, filed on Nov. 23, 1994, now abandoned.

BACKGROUND OF THE INVENTION

1. Field of the Invention

The present invention relates to a composite loud-speaker apparatus provided with loudspeakers for reproducing audio sound in a full range and a medium/low frequency range and to a method of driving the same, and particularly to a composite loud-speaker apparatus and method of driving the same which is reduced in size and has improved low frequency range.

2. Description of Related Art

FIG. 1 is a drawing showing the configuration of a composite loudspeaker apparatus of the prior art. In the drawing, numeral 1 denotes a full-range loudspeaker for the left (L) channel which reproduces the sound from an audio signal L of the L channel. The full-range reproduction loudspeaker 1 is enclosed in a closed cabinet 2. Numeral 3 denotes a full-range reproduction loudspeaker for the right (R) channel which reproduces the sound from an audio signal R of the R channel. The full-range reproduction loudspeaker 3 is enclosed in a closed cabinet 4.

The composite loudspeaker apparatus of the prior art, is further provided with a synthesis circuit 8 which synthesizes the audio signal L of the L channel and the audio signal R of the R channel, a low frequency range boost up circuit 9 for enhancing the low frequency range of the synthesized audio signals, and a low frequency range reproduction loudspeaker 5 for converting the output signal from the low frequency range boost up circuit 9 into audio sound. The low frequency range reproduction loudspeaker 5 is enclosed in a phase inverting cabinet 6 which has a volume greater than those of the closed cabinets 2 and 4. Inside of the phase inverting cabinet 6 is divided into a small air chamber and a large air chamber. The phase inverting cabinet 6 has a sound port 7 made in a wall of the small air chamber.

Now the operation will be described below. The audio signal L of the L channel is input to the full-range reproduction loudspeaker 1 and converted into audio sound, and the audio signal R of the R channel is input to the full-range reproduction loudspeaker 3 and converted into audio sound. The audio signals L and R of the L channel and the R channel are input to the synthesis circuit 8 where both signals are synthesized, and to the low-frequency range boost up circuit 9 where the signals are enhanced in the low frequency range. The enhanced signal is input to the low frequency range reproduction loudspeaker 5 and is converted into audio sound, The audio sound in the low frequency range radiated from the low frequency range reproduction loud-speaker 5 is enhanced through Helmholtz's resonance between the air in the sound port 7 and the air in the small air chamber, and then radiated from the sound port 7. As a result, the reproduced sound pressure characteristic in the low frequency range is enhanced.

The composite loudspeaker apparatus of the prior art, as constructed as described above, requires three cabinets (2, 4, 6) for the L channel, the R channel and the low frequency range reproduction. Also because increasing the reproduction frequency range for lower frequencies requires increasing the volume of the cabinet 6, greater installation space is needed.

SUMMARY OF THE INVENTION

The present invention has been developed to solve such problems as described above. One object of the present invention is to provide a composite loudspeaker apparatus which does not require an exclusive cabinet for a low frequency range reproduction loudspeaker and reduces the total internal volume of the cabinets as compared with the prior art, while enhancing the sound pressure characteristic in the low frequency range.

The composite loudspeaker apparatus of the invention comprises a cabinet which is divided, for example, into a first air chamber and a second air chamber having a sound port, a drone cone or a resonance duct. Installed in the first air chamber is a first loudspeaker for reproduction in the full frequency range or in the medium/low frequency range, and mounted in the second air chamber is a second loudspeaker for reproduction in the low frequency range. The first loudspeaker is driven by an audio signal of either one of the L and R channels, while the second loudspeaker is driven by the low frequency component of the synthesized audio signal of the L and R channels.

Also according to the invention, the second loudspeaker is driven in phase with the first loudspeaker.

Further according to the invention, the second loudspeaker can be disposed at the rear of the first loudspeaker in the same direction or in the reverse direction.

Consequently, the second loudspeaker for low frequency range reproduction mounted in the second air chamber acts as a drone cone driven by the back pressure of the first loudspeaker for full range reproduction or low/medium frequency range reproduction at frequencies higher than the low-frequency component, and thereby contributes to the improvement and smoothing of the reproduced sound pressure characteristic in the low frequency range in the low frequency component, on the other hand, the two loudspeakers disposed one behind the other are driven substantially in phase, and therefore air in the first air chamber is not compressed so that the performance of the full-range reproduction loudspeaker and the low frequency range reproduction loudspeaker is improved.

Further because low-frequency sound radiated from the second air chamber is enhanced through resonance between the air in the second air chamber and the air in the sound port or the air in the resonance duct, or enhanced through resonance of the air in the second air chamber and the drone cone, the reproduced sound pressure characteristic in the low frequency range is enhanced.

Also in the apparatus of the present invention, a third air chamber having a sound port or a drone cone or a resonance duct is disposed adjacent to the second air chamber provided with the sound port or the drone cone. Consequently, the resonance is doubly enhanced so that the reproduced sound pressure characteristic in the low frequency range is further enhanced.

Further the apparatus of the present invention is provided with the first and the second air chambers in the cabinet, wherein the first loudspeaker is driven by the audio signal of one channel and a third loudspeaker mounted in another cabinet having a sound port or a drone cone or a resonance duct is driven by the audio signal of the other channel.

Also in the apparatus of the present invention, the first loudspeaker is driven by the audio signal of one channel, while the third loudspeaker mounted in a first air chamber of another cabinet, which is divided into a third air chamber having a sound port or a drone cone and a fourth air chamber having a sound port or a drone cone or a resonance duct, is driven by the audio signal of the other channel.

Therefore, the reproduced sound pressure characteristic in the low frequency range of the other channel is enhanced and the difference in the reproduced sound pressure characteristic between the L and R channels is reduced.

Also the method of driving the composite loudspeaker apparatus of the present invention includes driving the first loudspeaker for full-range reproduction or low/medium frequency range reproduction, mounted in the first air chamber of the cabinet which is divided into at least two air chambers, with the audio signal of either channel of the L and R channels, while the second loudspeaker for low frequency reproduction mounted in the second air chamber provided with a sound port or a drone cone or a resonance duct is driven by the low frequency component of the synthesized audio signal of the L, R channels.

In the driving method described above, the low frequency range reproduction loudspeaker is driven in phase with the first loudspeaker with the low frequency component of the synthesized audio signal of the L, R channels.

Consequently, the low frequency range reproduction loudspeaker is driven by only the low frequency component, and no peak or dip arises in the medium and high frequency range even when the driving signals for both loudspeakers are slightly out of phase.

The above and further objects and features of the invention will more fully be apparent from the following detailed description with accompanying drawings.

DESCRIPTION OF THE PREFERRED EMBODIMENTS

The invention will now be described in detail below with reference to the drawings showing the preferred embodiments.

Embodiment 1

Figure 2:
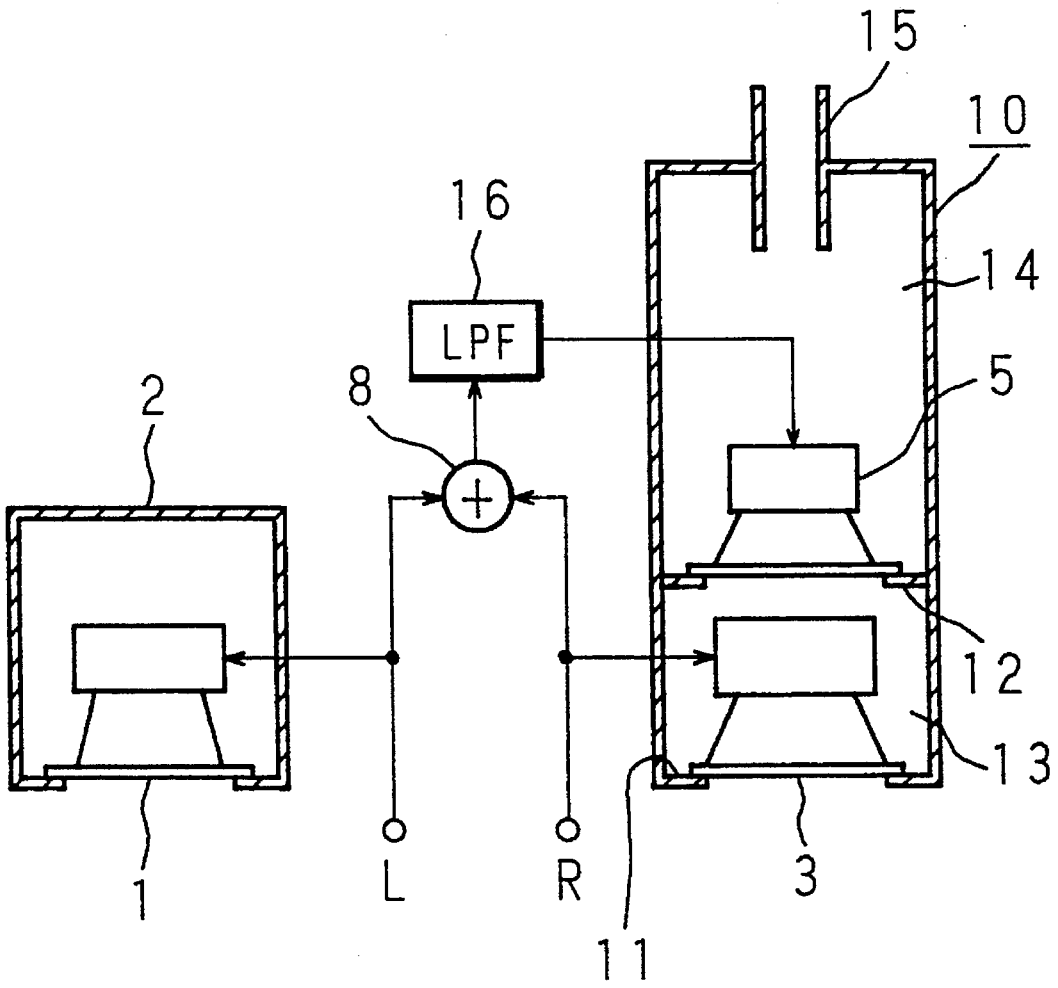
FIG. 2 is a drawing showing the configuration of a composite loudspeaker apparatus of embodiment 1 of the invention.

FIG. 2 is a drawing showing the configuration of a composite loudspeaker apparatus of embodiment 1 of the present invention. In the drawing, numeral 1 denotes a full-range reproduction loudspeaker for L channel which reproduces the sound from the audio signal L of the L channel. The full-range reproduction loudspeaker 1 is enclosed in a closed cabinet 2.

Numeral 10 denotes a cabinet of rectangular cross section wherein a first air chamber 13 and a second air chamber 14 are disposed in series. The cabinet 10 has greater volume than the closed cabinet 2. Installed in the first air chamber 13 is a full-range reproduction loudspeaker 3 for the R channel which reproduces the sound from the audio signal R of the R channel. Installed in the second air chamber 14 is a low frequency range reproduction loudspeaker 5. The audio signal L of the L channel and the audio signal R of the R channel are synthesized in the synthesis circuit 8 and passed through a low-pass filter 16. The sound signal of the low frequency component which is output from the low-pass filter 16 is fed to the low frequency range reproduction loudspeaker 5, and the low-frequency range reproduction loudspeaker 5 reproduces the sound from the audio signal of the low frequency component.

The cabinet 10 has a sound port 15 installed on one of the two surfaces thereof opposing each other in the longitudinal direction, namely on the surface on the second air chamber 14 side, and a baffle 11 is installed on another surface, namely on the surface on the first air chamber 13 side, with a full-range reproduction loudspeaker 3 being mounted on the baffle 11. In the cabinet 10, a sub-baffle 12 is installed on the inner wall near to the baffle 11, and the 1 w frequency range reproduction loudspeaker 5 is mounted on the sub-baffle 12. The cabinet 10 is partitioned into two air chambers (13, 14) by the sub-baffle 12 and the low frequency range reproduction loudspeaker 5.

Now the operation will be described below. The audio signal L of the L channel is input to the full-range reproduction loudspeaker 1 where the audio signal L is converted into sound. The audio signal R of the R channel is input to the full-range reproduction loudspeaker 3 where the audio signal R is converted into sound. The audio signal L of the L channel and the audio signal R of the R channel are also input to the synthesis circuit 8 to be synthesized, and the synthesized audio signal thus obtained is fed to low-pass filter 16. The low-pass filter 16 has a cutoff frequency $f_0$ of 100 Hz, for example, and allows only the synthesized audio signal of frequencies lower than the cutoff frequency $f_0$ to pass therethrough. The synthesized audio signal of low frequency component thus obtained is fed to the low frequency range reproduction loudspeaker 5 to drive the low frequency reproduction loudspeaker 5 in phase with the full-range reproduction loudspeaker 3.

The low frequency range reproduction loudspeaker 5 driven by the low frequency component of the synthesized audio signal acts, in a range of frequencies higher than the cutoff frequency $f_0$, as a drone cone (a cone which does not function positively) of the full-range reproduction loudspeaker 3. This results in such an effect as increasing the reproduced sound pressure level of the full-range reproduction loudspeaker 3 in the low frequency range and an effect of smoothing peaks and dips.

In the range of frequencies lower than the cutoff frequency $f_0$, on the other hand, because the loudspeakers 3, 5 in the cabinet 10 operate in phase with each other, the first air chamber 13 can function as if it has a larger volume, which improves the efficiency of driving the full-range reproduction loudspeaker 3 thereby increasing the reproduced sound pressure level in the low frequency range. Further because the air in the second air chamber 14 is subjected to double driving thereby to radiate reproduced sound of the low frequency component which has been enhanced by resonance through the sound port 15, thus the reproduced sound pressure characteristics of the second air chamber 14 and the sound port 15 around the resonance frequency are enhanced.

Figure 1:
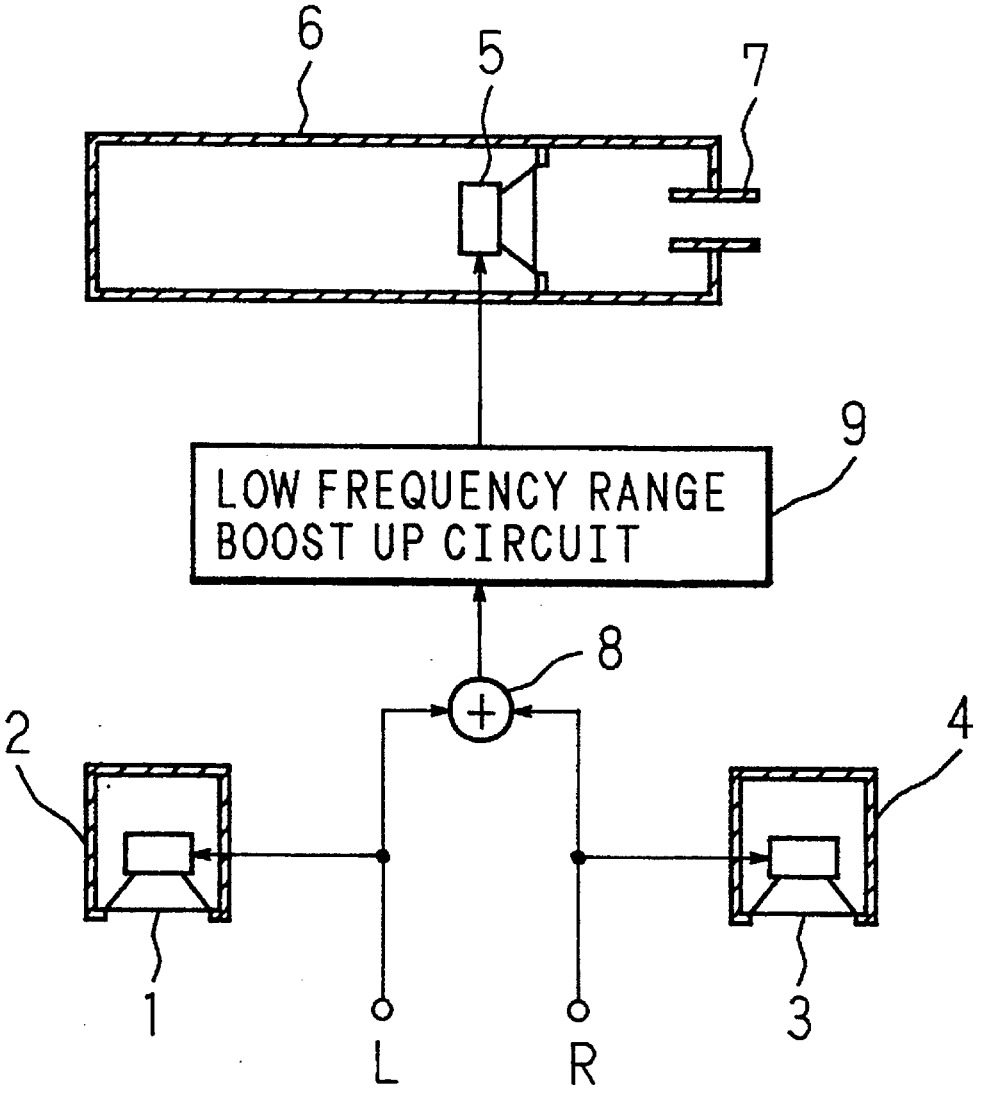
FIG. 1 PRIOR ART
FIG. 1 is a drawing showing the configuration of a composite loudspeaker apparatus of the prior art.
Figure 3:
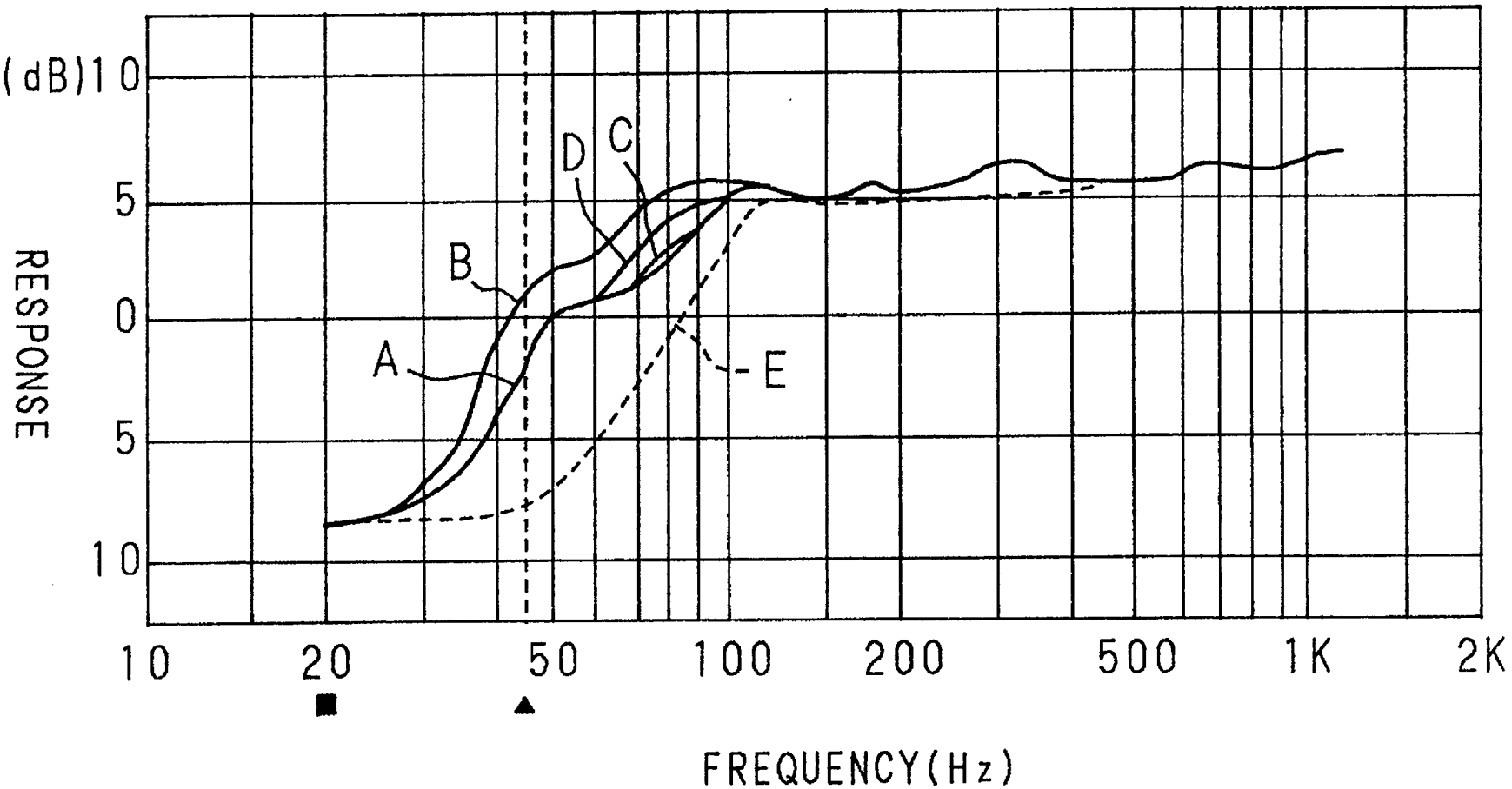
FIG. 3 is a drawing showing the reproduced sound pressure characteristics of each embodiment and the prior art.

FIG. 3 is a drawing explaining the frequency characteristic of the reproduced sound pressure level of the composite loudspeaker apparatus. Curve A in the drawing represents the reproduced sound pressure characteristic of the embodiment 1, while curve E plotted with dashed line represents the reproduced sound pressure characteristic of the apparatus of the prior art shown in FIG. 1. This characteristic drawing represents a case where the total volume of the three cabinets (2, 4, 6) of the prior art shown in FIG. 1 and the total volume of the two cabinets (2, 10) shown in FIG. 2 are set to be equal to each other, indicating that embodiment 1 has better reproduced sound pressure characteristic than the prior art. In case the configuration shown in FIG. 2 is made to have the same reproduced sound pressure characteristic as the prior art, the inner volume of the cabinet (10) can be made smaller than that of the embodiment 1.

Embodiment 2

Figure 4:
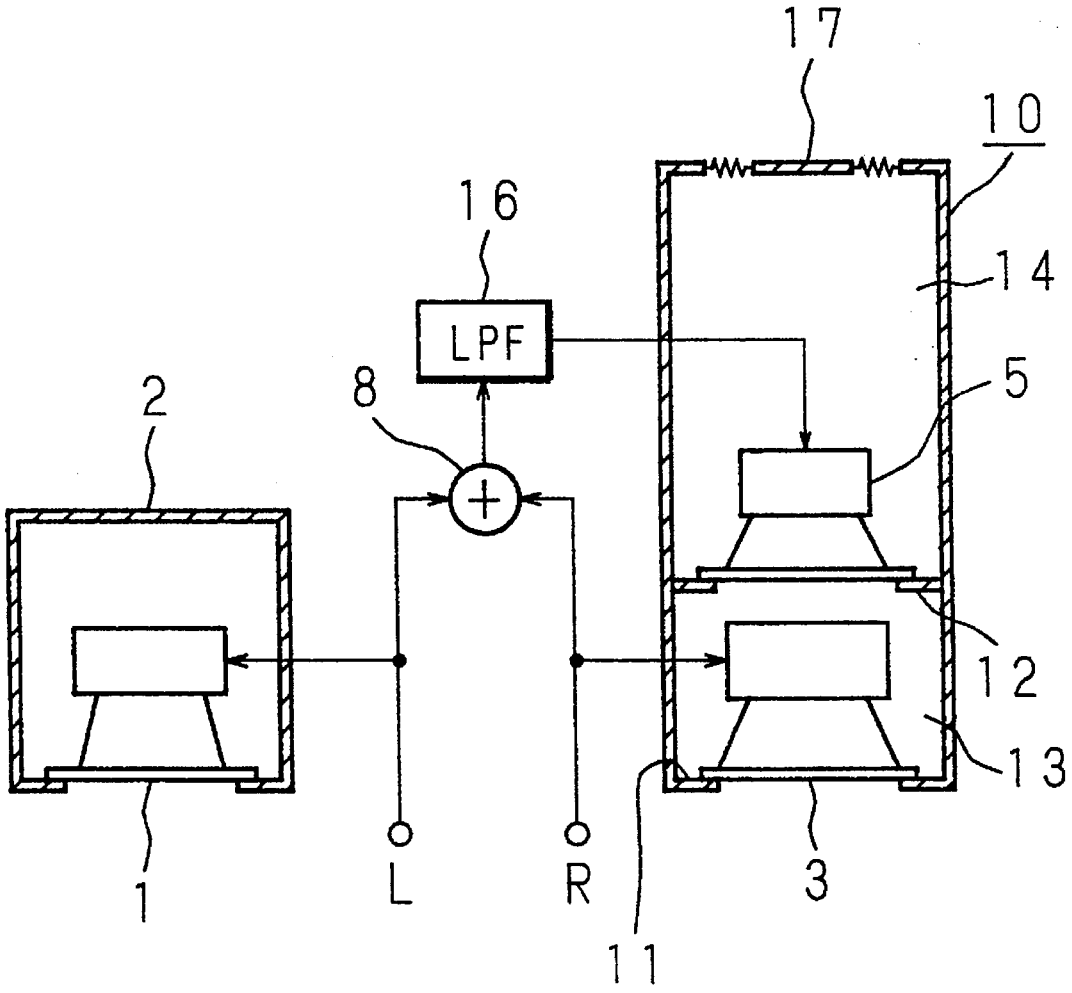
FIG. 4 is a drawing showing the configuration of a composite loudspeaker apparatus of embodiment 2 of the invention.

FIG. 4 is a drawing showing the configuration of a composite loudspeaker apparatus of embodiment 2 of the present invention. This embodiment is a variation of embodiment 1 shown in FIG. 2 wherein the sound port 15 is replaced with the drone cone 17. In other respects, the configuration is similar to that shown in FIG. 2 and therefore description thereof will be omitted with the same numerals assigned to corresponding components.

In embodiment 2, the drone cone 17 radiates low-distortion sound with high efficiency due to resonance of the air in the second air chamber 14 and the drone cone 17, resulting in reproduced sound pressure characteristic substantially similar to that of the characteristic curve A shown in FIG. 3, while low frequency region of the characteristic curve is more enhanced to become flat than in the case of employing the sound port 15.

Embodiment 3

Figure 5:
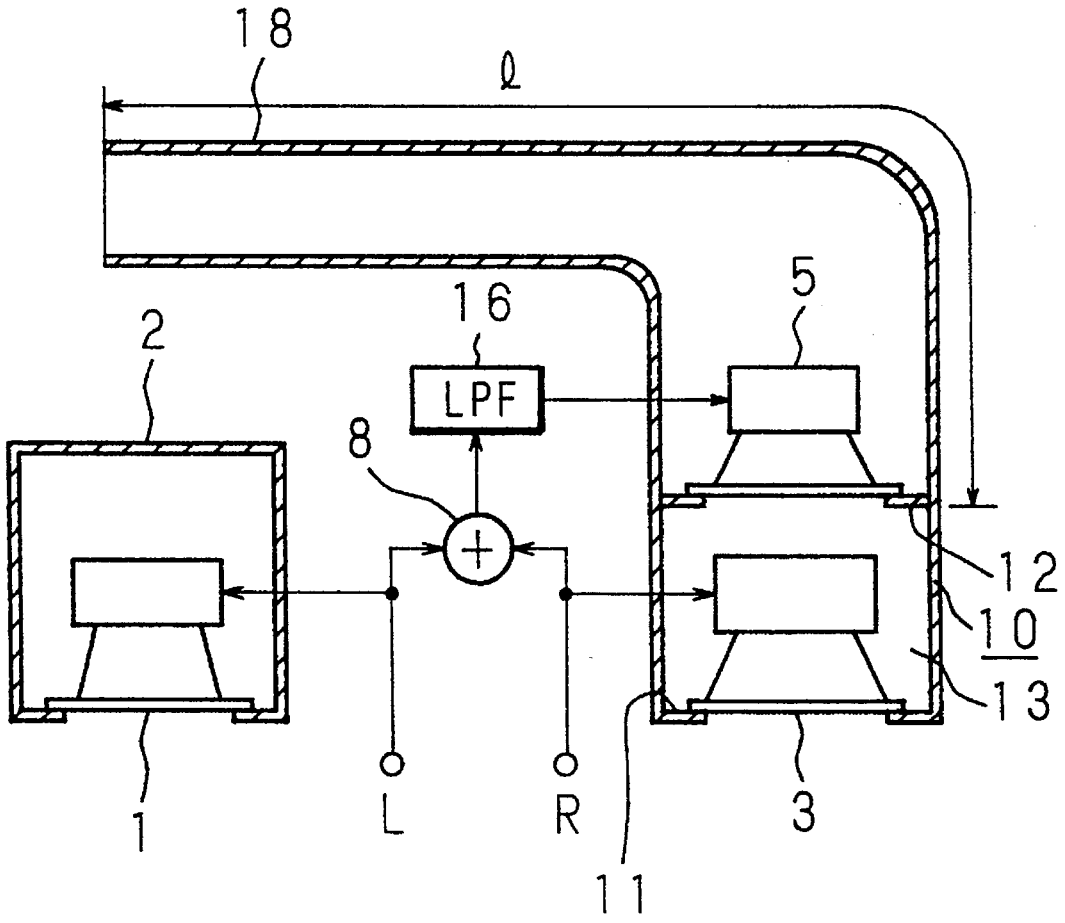
FIG. 5 is a drawing showing the configuration of a composite loudspeaker apparatus of embodiment 3 of the invention.

FIG. 5 is a drawing showing the configuration of a composite loudspeaker apparatus of embodiment 3 of the present invention. In this embodiment, the second air chamber 14 of the embodiment 1 shown in FIG. 2 is replaced with a resonance duct 18 made in L shape which is open at one end thereof. In other respects, the configuration is similar to that shown in FIG. 2 and therefore description thereof will be omitted with the same numerals assigned to corresponding components.

According to embodiment 3, a standing wave of frequency $f_n$ given as follows is generated in the resonance duct of length l with one end thereof being closed.

$$f_n=(C/41)\cdot(2n+1)$$

where n: 0, 1, 2, 3, . . . C: Sound velocity

Thus low frequency sound is enhanced by making use of the maximum standing wave $f_{max}$ generated when n is 0. Consequently the reproduced sound pressure characteristic at low frequencies is more enhanced than in embodiment 1, though distortion increases a little and the cabinet 18 has a greater total volume.

Embodiment 4

Figure 6:
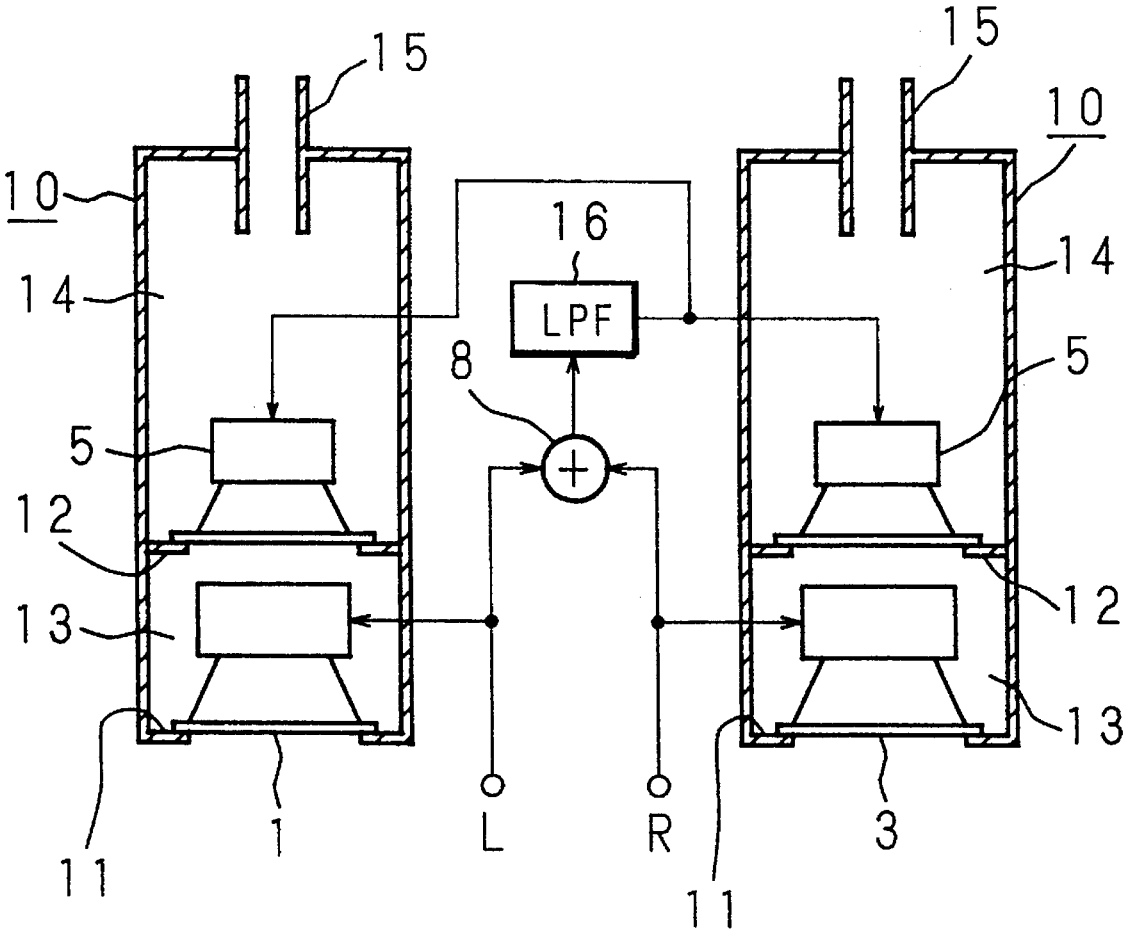
FIG. 6 is a drawing showing the configuration of a composite loudspeaker apparatus of embodiment 4 of the invention.

FIG. 6 is a drawing showing the configuration of a composite loudspeaker apparatus of embodiment 4 of the present invention. The apparatus of this embodiment has two cabinets 10 shown in FIG. 2. Installed in the first air chamber 13 of one cabinet 10 is the full-range reproduction loudspeaker 1 of L channel, and mounted in the second air chamber 14 is the low frequency range reproduction loudspeaker 5. Installed in the first air chamber 13 of the other cabinet 10 is the full-range reproduction loudspeaker 3 of R channel, and mounted in the second air chamber 14 is the low frequency range reproduction loudspeaker 5. Audio signal of low frequency component which is output from the low-pass filter 16 is fed to the low frequency range reproduction loudspeakers 5, 5 mounted in the cabinets 10, 10.

According to embodiment 4, because the cabinet 10 having the effects described in embodiment 1 is installed also for the L channel, similar effects to those described above can be obtained from the L channel, too. That is, the reproduced sound pressure level in the low frequency range is increased, and the reproduced sound pressure characteristic around the resonance frequencies of the second air chamber 14 and the sound port 15 is enhanced. Consequently the reproduced sound pressure characteristic as represented by the curve B in FIG. 3 can be obtained.

Embodiment 5

Figure 7:
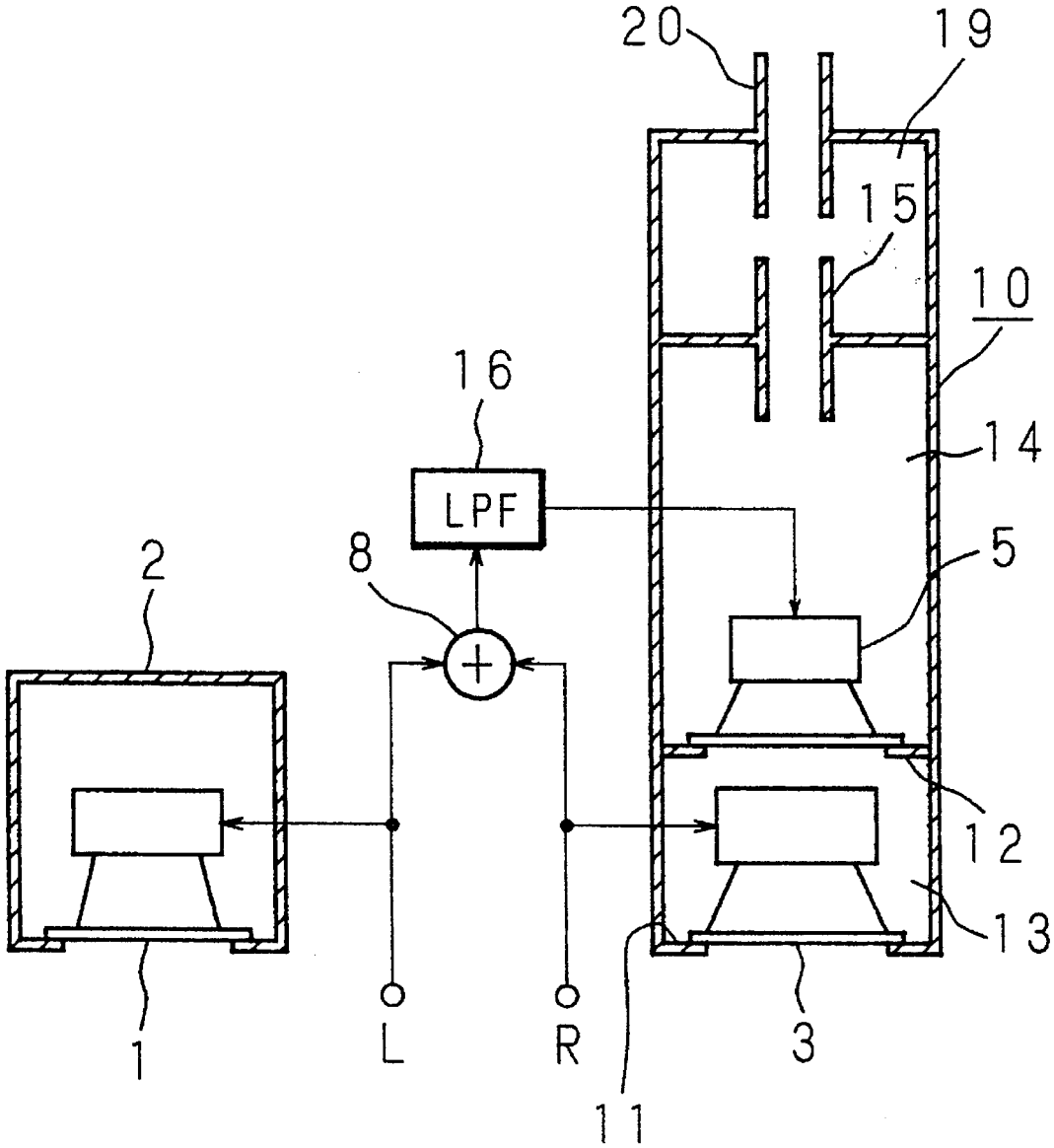
FIG. 7 is a drawing showing the configuration of a composite loudspeaker apparatus of embodiment 5 of the invention.

FIG. 7 is a drawing showing the configuration of a composite loudspeaker apparatus of embodiment 5 of the present invention. The cabinet 10 in this embodiment has a third air chamber 19 communicating with the second air chamber 14 shown in FIG. 2. The third air chamber 19 has a sound port 20. In other respects, the configuration is similar to that shown in FIG. 2 and therefore description thereof will be omitted with the same numerals assigned to corresponding components.

In embodiment 5, because Helmholtz resonance is doubly effected, in the second air chamber 14 and in the third air chamber 19, the efficiency of driving the low frequency range reproduction loudspeaker 5 can be made higher than in the case of the embodiment 1, so that the reproduced sound pressure characteristic in the low frequency range is further enhanced similarly to the curve A in FIG. 3 while suppressing peaks and dips.

Embodiment 6

Figure 8:
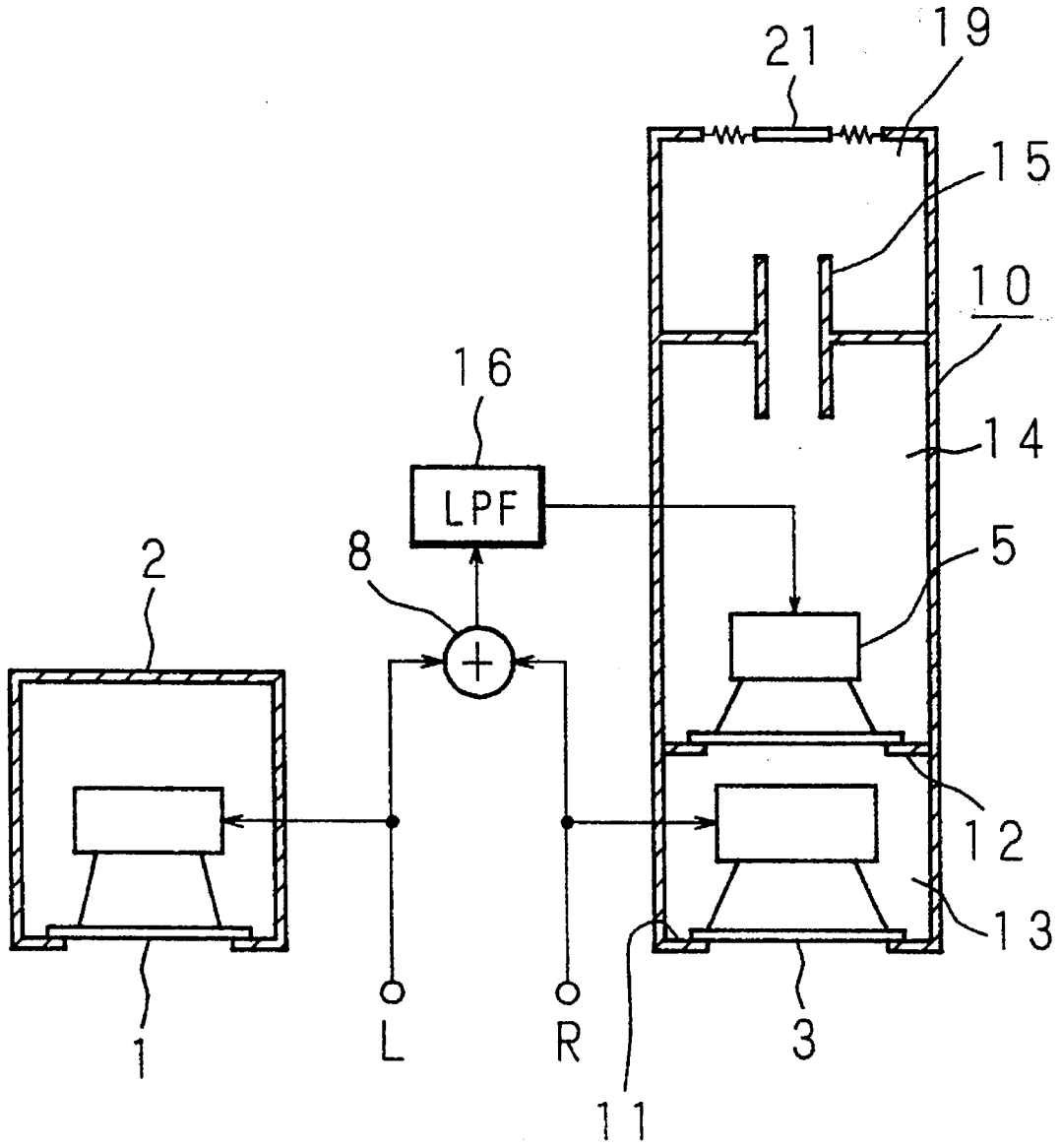
FIG. 8 is a drawing showing the configuration of a composite loudspeaker apparatus of embodiment 6 of the invention.

FIG. 8 is a drawing showing the configuration of a composite loudspeaker apparatus of embodiment 6 of the present invention. In this embodiment, the sound port 20 of the third air chamber 19 in the embodiment 5 shown in FIG. 7 is replaced with a drone cone 21. In other respects, the configuration is similar to that shown in FIG. 7 and therefore description thereof will be omitted with the same numerals assigned to corresponding components.

According to embodiment 6, low frequency sound of high efficiency and less distortion is radiated from the drone cone 21 owing to the resonance of the air in the third air chamber 19 and the drone cone 21. Therefore reproduced sound pressure characteristic can be enhanced with less distortion over a wider low frequency range than in the case of the embodiment 5. The reproduced sound pressure characteristic in this case is substantially similar to the characteristic curve A shown in FIG. 3.

Embodiment 7

Figure 9:
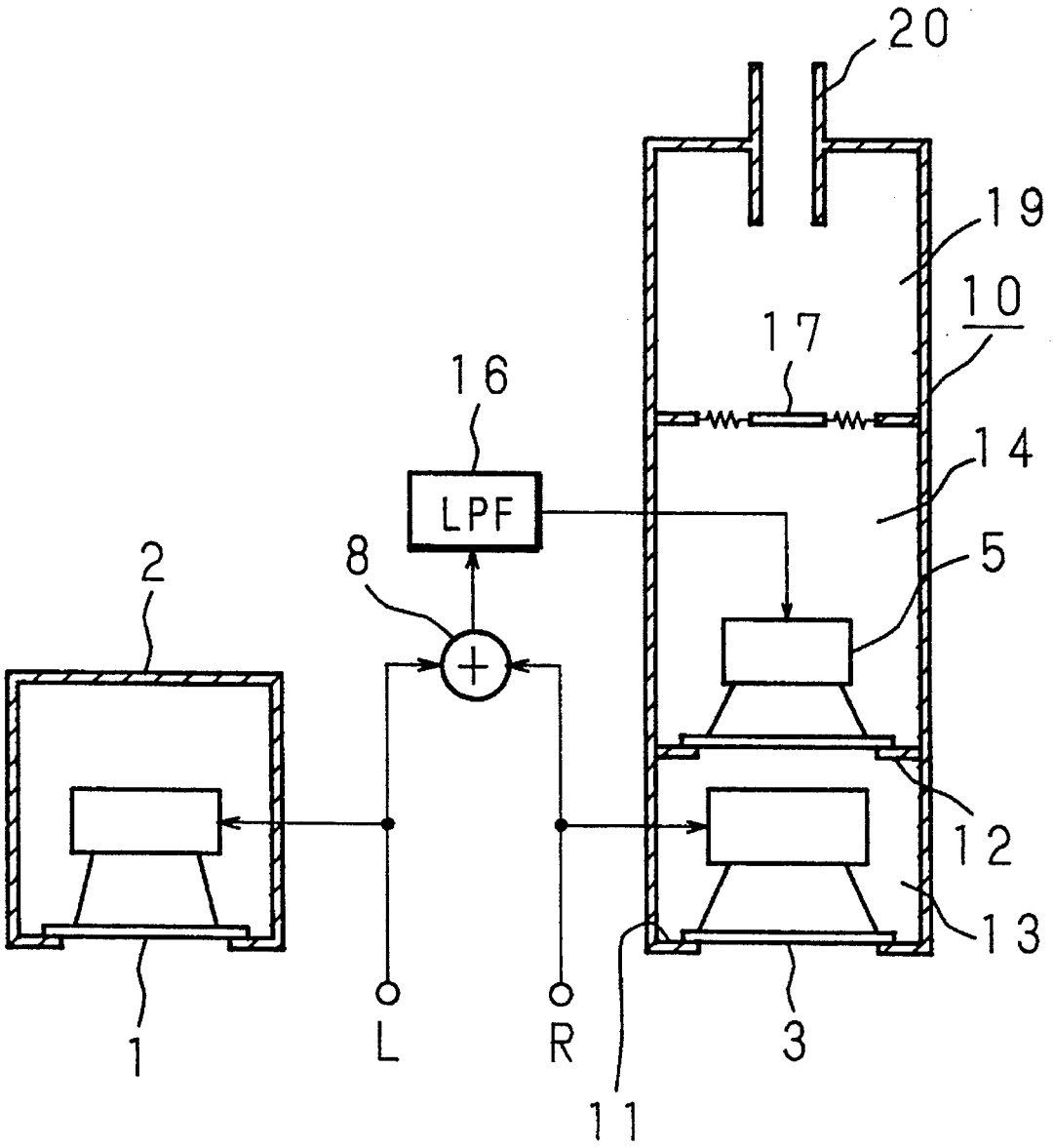
FIG. 9 is a drawing showing the configuration of a composite loudspeaker apparatus of embodiment 7 of the invention.

FIG. 9 is a drawing showing the configuration of a composite loudspeaker apparatus of embodiment 7 of the present invention. In this embodiment, the sound port 18 of the second air chamber 14 in embodiment 5 shown in FIG. 7 is replaced with the drone cone 17. In other respects, the configuration is similar to that shown in FIG. 7 and therefore description thereof will be omitted with the same numerals assigned to corresponding components.

According to embodiment 7, although the reproduced sound pressure characteristic in the low frequency range can be enhanced similarly to the embodiment 5, the effect of suppressing the peak and dip is reduced. In this case, too, the reproduced sound pressure characteristic similar to the characteristic curve A shown in FIG. 3 can be obtained.

In the embodiments 5, 6 and 7, the sound port 20 and the drone cone 21 may be replaced with a resonance duct.

Embodiment 8

Figure 10:
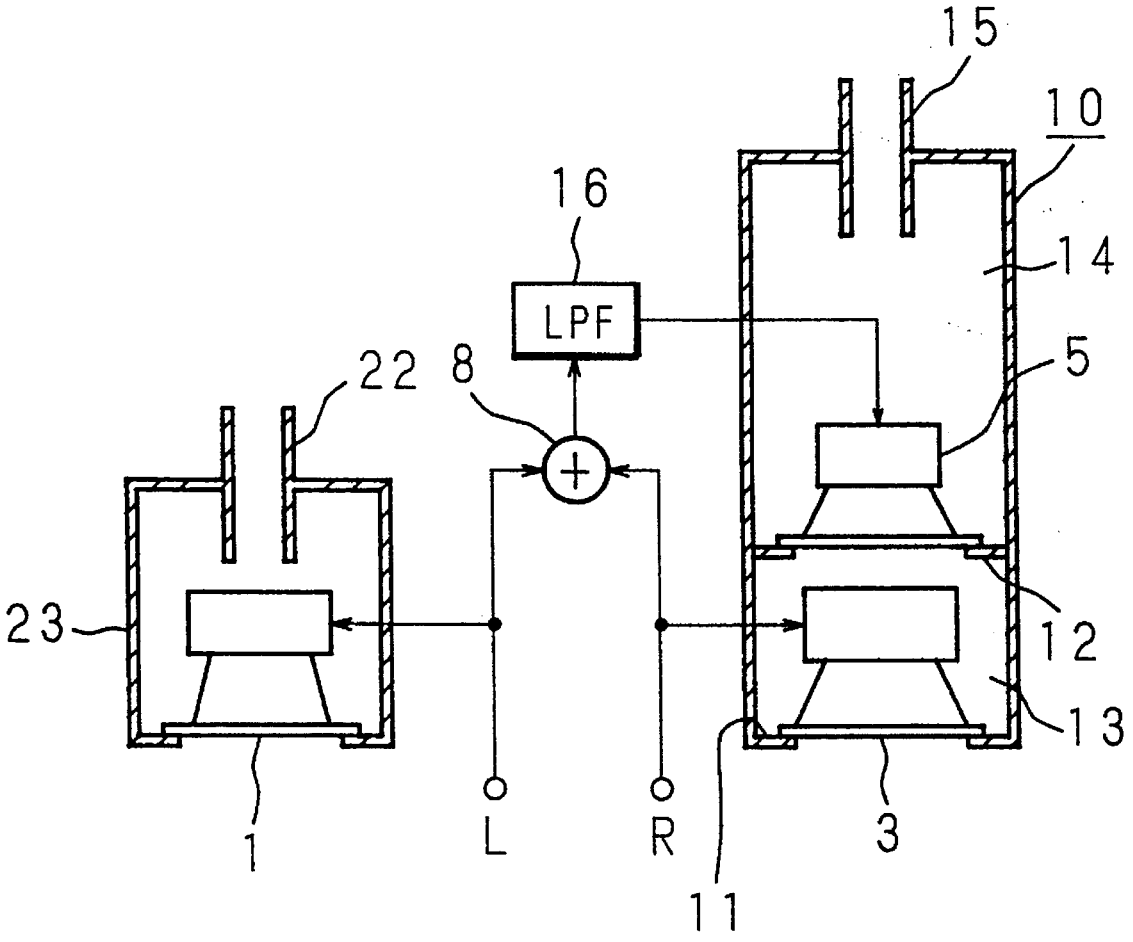
FIG. 10 is a drawing showing the configuration of a composite loudspeaker apparatus of embodiment 8 of the invention.

FIG. 10 is a drawing showing the configuration of a composite loudspeaker apparatus of embodiment 8 of the present invention. In this embodiment, the closed cabinet 2 in embodiment 1 shown in FIG. 2 is replaced with a cabinet 23 having a sound port 22. In other respects, the configuration is similar to that shown in FIG. 2 and therefore description thereof will be omitted with the same numerals assigned to corresponding components.

According to embodiment 8, because the reproduced sound pressure characteristic in the medium/low frequency range can be enhanced in a range from 80 to 200 Hz as shown by the characteristic curve C shown in FIG. 3 by adjusting the dimensions of the sound port 22, the difference in the reproduced sound pressure characteristic between the L channel and the R channel can be decreased.

Embodiment 9

Figure 11:
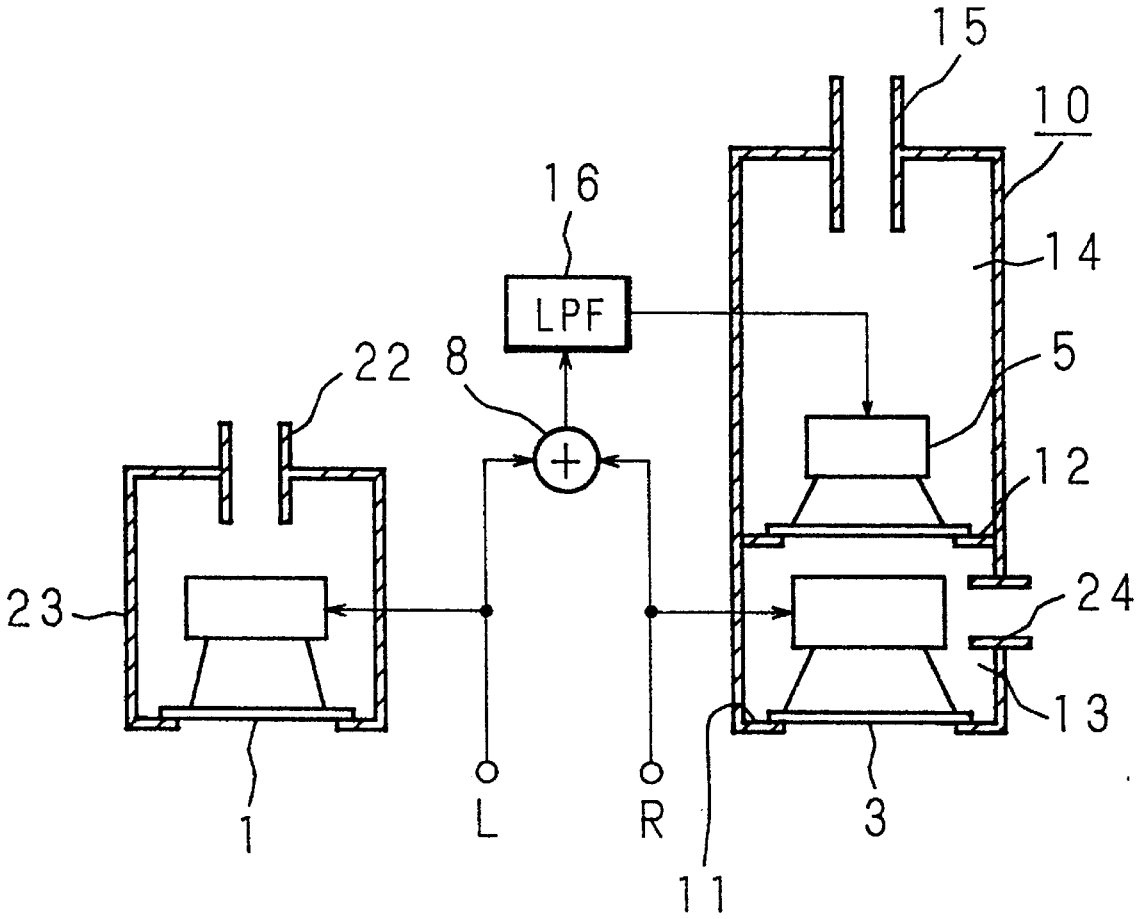
FIG. 11 is a drawing showing the configuration of a composite loudspeaker apparatus of embodiment 9 of the invention.

FIG. 11 is a drawing showing the configuration of a composite loudspeaker apparatus of embodiment 9 of the present invention. In this embodiment, the first air chamber 13 of the embodiment 8 shown in FIG. 10 is provided with a sound port 24 installed therein. In other respects, the configuration is similar to that shown in FIG. 10 and therefore description thereof will be omitted with the same numerals assigned to corresponding components.

According to embodiment 9, because the air in the first air chamber 13 is double-driven by the two loudspeakers 3 and 5, driving efficiency is improved and the reproduced sound pressure characteristic in the medium/low frequency range can be enhanced more than in the case of the embodiment 8 as shown by the curve D in FIG. 3.

Embodiment 10

Figure 12:
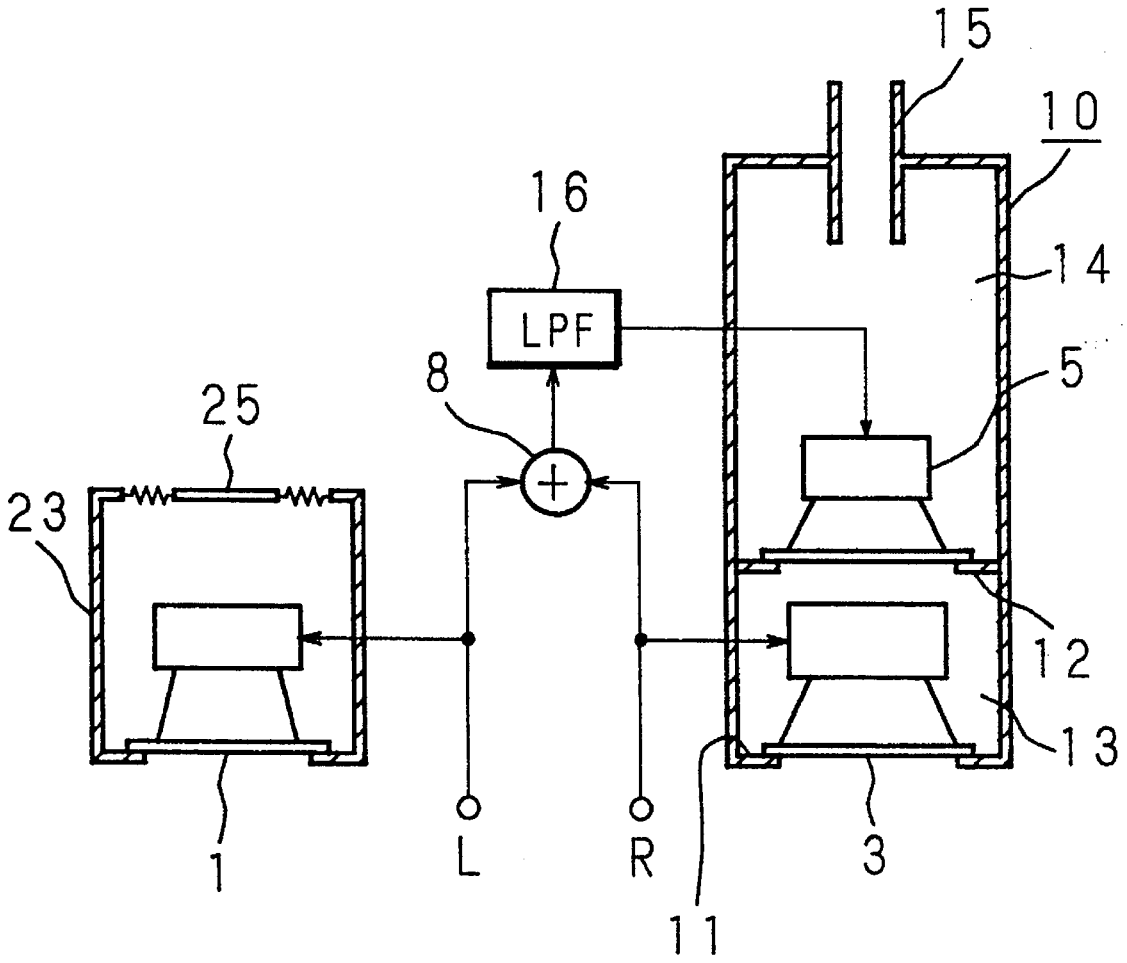
FIG. 12 is a drawing showing the configuration of a composite loudspeaker apparatus of embodiment 10 of the invention.

FIG. 12 is a drawing showing the configuration of a composite loudspeaker apparatus of embodiment 10 of the invention. In this embodiment, the sound port 22 in embodiment 8 shown in FIG. 10 is replaced with a drone cone 25. In other respects, the configuration is the same as that shown in FIG. 10 and therefore description thereof will be omitted with the same numerals assigned to corresponding components.

Although the reproduced sound pressure characteristic of embodiment 10 is similar to the characteristic curve C shown in FIG. 3, the characteristic has less peaks and dips, and distortion is also reduced.

Embodiment 11

Figure 13:
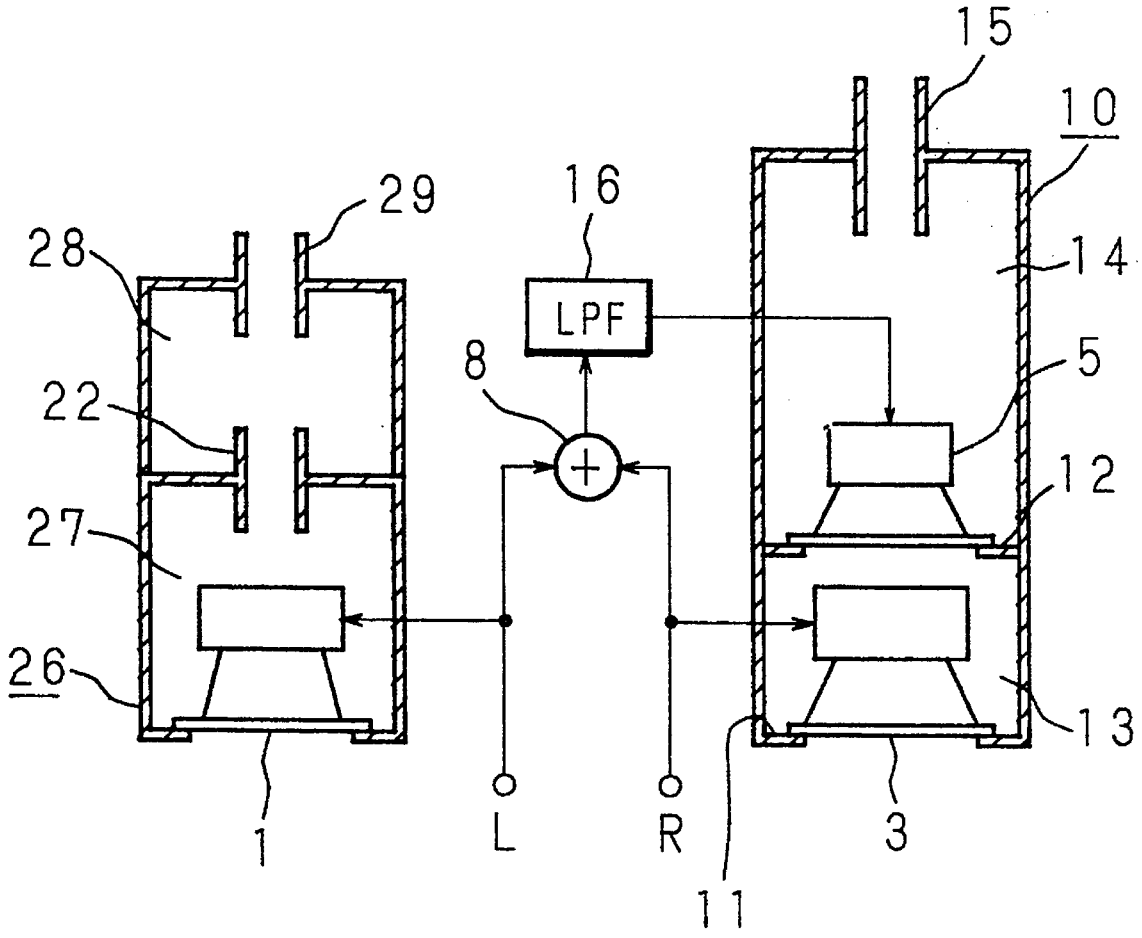
FIG. 13 is a drawing showing the configuration of a composite loudspeaker apparatus of embodiment 11 of the invention.

FIG. 13 is a drawing showing the configuration of a composite loudspeaker apparatus of embodiment 11 of the present invention. A cabinet 26 of L channel in this embodiment is made in a double phase inverting configuration having a first air chamber 27 and a second air chamber 28. Mounted in the first air chamber 27 is the full-range reproduction loudspeaker 1 and a sound port 22 is provided. The second air chamber 28 is also provided with a sound port 29. In other respects, the configuration is the same as that shown in FIG. 10 and therefore description thereof will be omitted with the same numerals assigned to corresponding components.

According to embodiment 11, because the air in the second air chamber 28 is double-driven thereby to radiate reproduced sound with the low frequency component enhanced by resonance through the sound port 29, the reproduced sound pressure characteristic around the resonance frequencies of the second air chamber 28 and the sound port 29 is enhanced. Therefore, the reproduced sound pressure characteristic at low frequencies in the L channel is enhanced more than in the case of embodiment 8 and peaks and dips are further reduced, resulting in further reduced difference in the reproduced sound pressure between the L and R channels. The reproduced sound pressure characteristic of embodiment 11 is similar to the characteristic curve C shown in FIG. 3.

Embodiment 12

Figure 14:
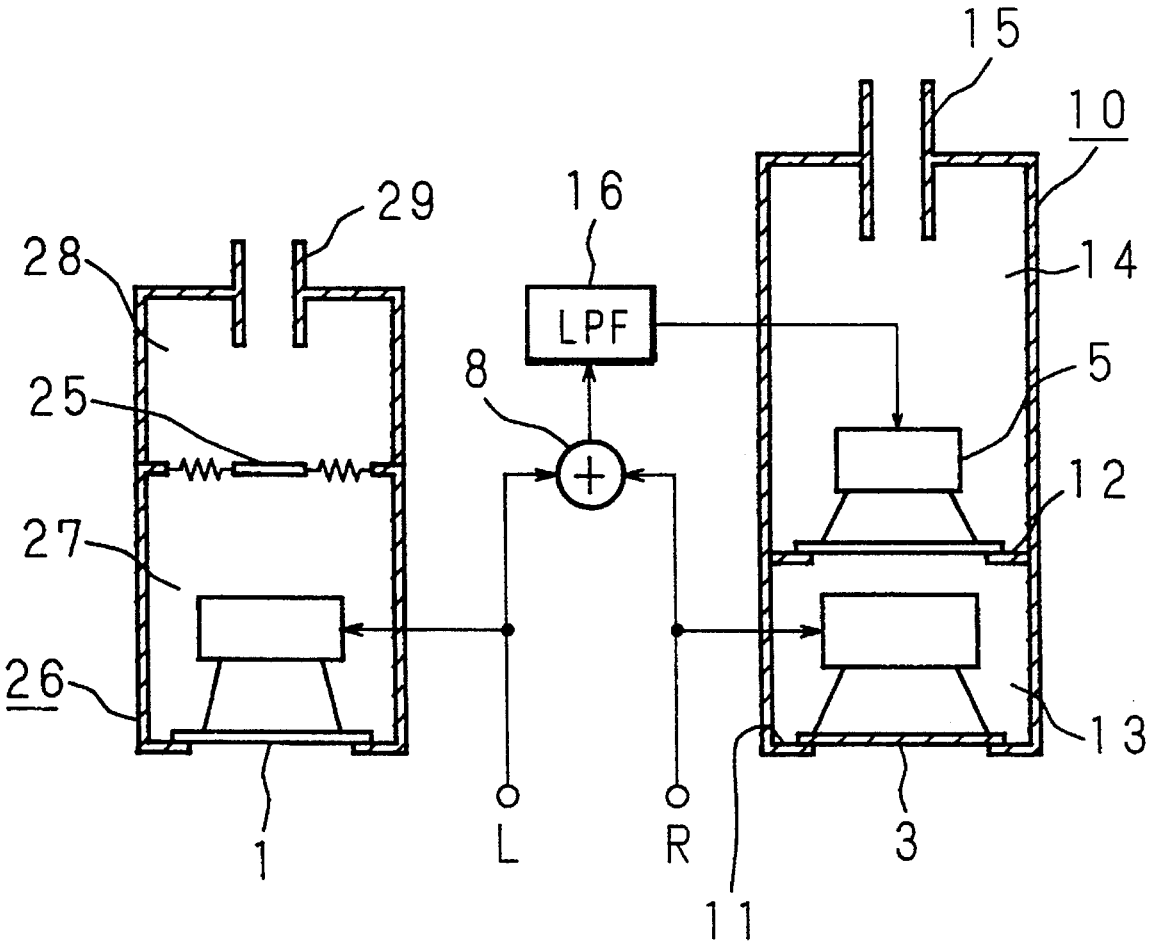
FIG. 14 is a drawing showing the configuration of a composite loudspeaker apparatus of embodiment 12 of the invention.

FIG. 14 is a drawing showing the configuration of a composite loudspeaker apparatus of embodiment 12 of the present invention. In this embodiment, the sound port 22 of embodiment 11 shown in FIG. 13 is replaced with the drone cone 25. In other respects, the configuration is the same as that shown in FIG. 13 and therefore description thereof will be omitted with the same numerals assigned to corresponding components.

Although the reproduced sound pressure characteristic of embodiment 12 is similar to the characteristic curve C shown in FIG. 3, the characteristic has less peaks and dips to become flat, and distortion is also reduced.

Embodiment 13

Figure 15:
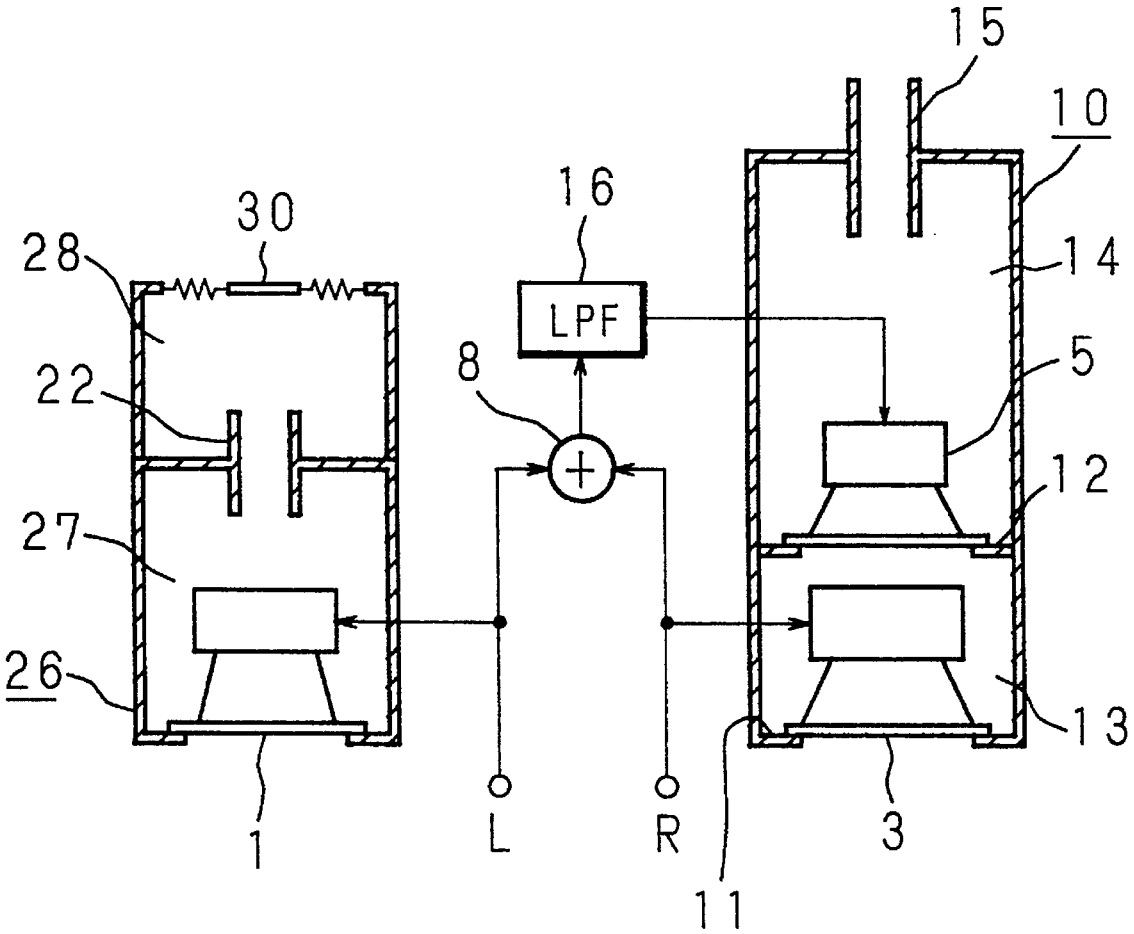
FIG. 15 is a drawing showing the configuration of a composite loudspeaker apparatus of embodiment 13 of the invention.

FIG. 15 is a drawing showing the configuration of a composite loudspeaker apparatus of embodiment 13 of the present invention. In this embodiment, the sound port 29 of the embodiment 11 shown in FIG. 13 is replaced with a drone cone 30. In other respects, the configuration is the same as that shown in FIG. 13 and therefore description thereof will be omitted with the same numerals assigned to corresponding components.

The reproduced sound pressure characteristic of embodiment 13 is similar to that of embodiment 12.

Embodiment 14

Figure 16:
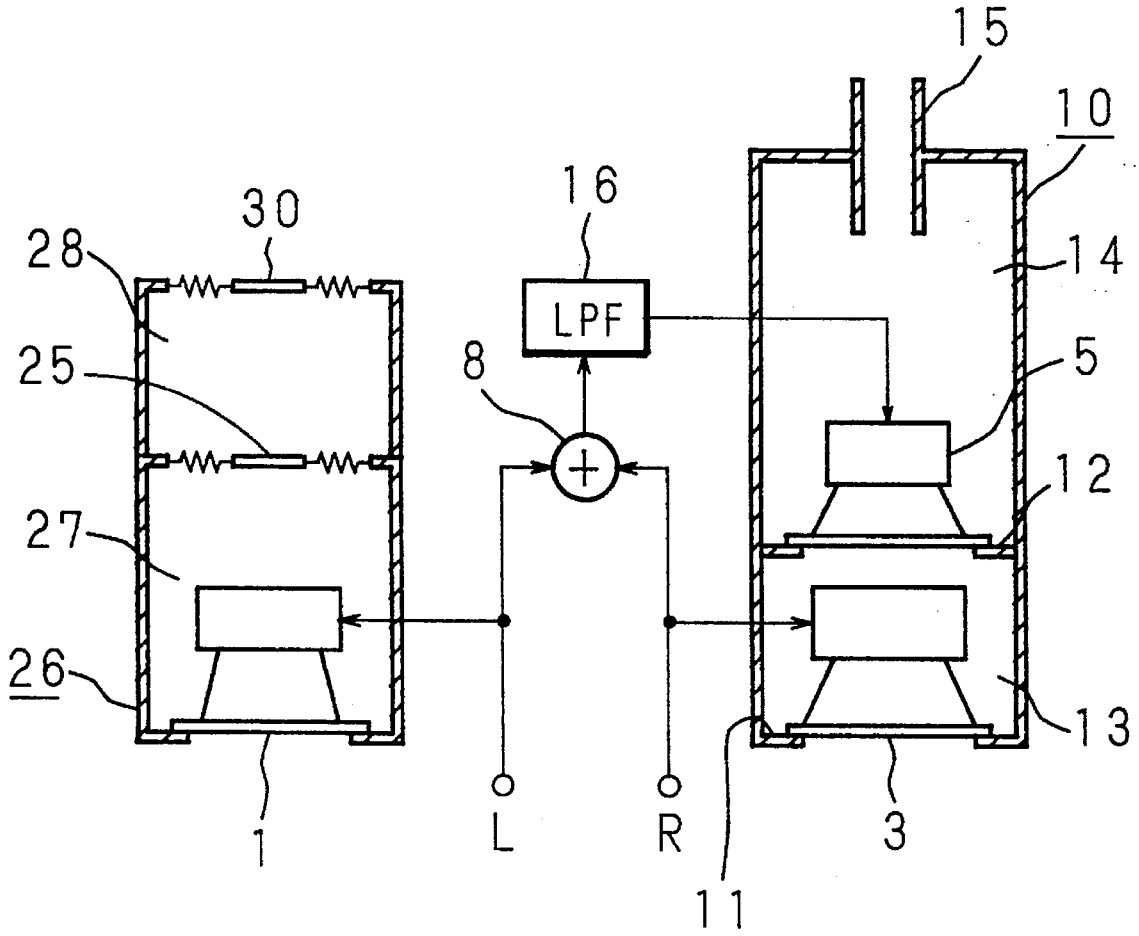
FIG. 16 is a drawing showing the configuration of a composite loudspeaker apparatus of embodiment 14 of the invention.

FIG. 16 is a drawing showing the configuration of a composite loudspeaker apparatus of embodiment 14 of the present invention. In this embodiment, the sound port 29 of embodiment 12 shown in FIG. 14 is replaced with the drone cone 30. In other respects, the configuration is similar to that shown in FIG. 14 and therefore description thereof will be omitted with the same numerals assigned to corresponding components.

Although the reproduced sound pressure characteristic of embodiment 14 is similar to that of embodiment 12, distortion is reduced.

Embodiment 15

Figure 17:
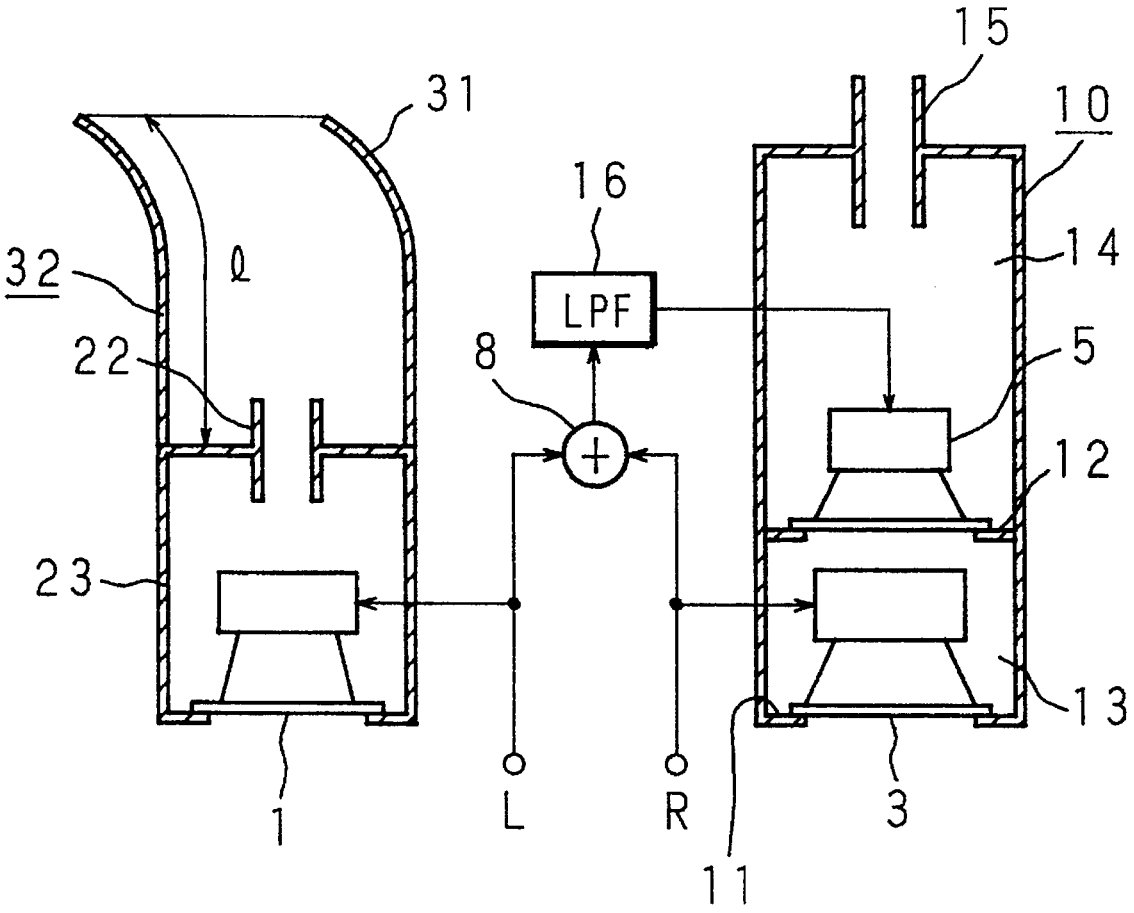
FIG. 17 is a drawing showing the configuration of a composite loudspeaker apparatus of embodiment 15 of the invention.

FIG. 17 is a drawing showing the configuration of a composite loudspeaker apparatus of embodiment 15 of the present invention. In this embodiment, a cabinet 32 of such a configuration as a resonance duct 31 is installed behind the cabinet 23 of embodiment 9 shown in FIG. 11. In other respects, the configuration is similar to that shown in FIG. 11 and therefore description thereof will be omitted with the same numerals assigned to corresponding components.

Although the reproduced sound characteristic of the embodiment 15 is similar to the characteristic curve C shown in FIG. 3, the low frequency range is more enhanced than in the case of embodiment 11.

Embodiment 16

Figure 18:
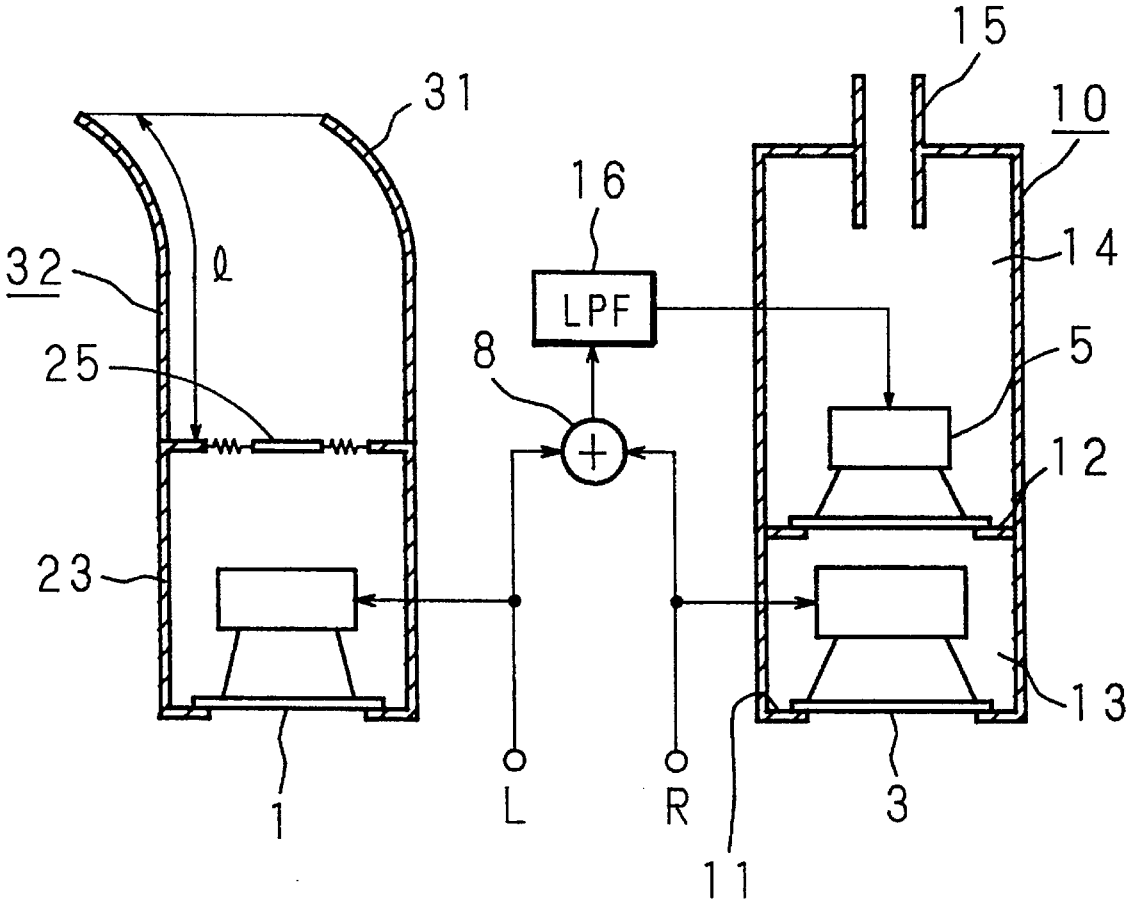
FIG. 18 is a drawing showing the configuration of a composite loudspeaker apparatus of embodiment 16 of the invention.

FIG. 18 is a drawing showing the configuration of a composite loudspeaker apparatus of embodiment 16 of the present invention. In this embodiment, the sound port 22 in embodiment 15 shown in FIG. 17 is replaced with the drone cone 25. In other respects, the configuration is the same as that shown in FIG. 17 and therefore description thereof will be omitted with the same numerals assigned to corresponding components.

Although the reproduced sound pressure characteristic of embodiment 16 is similar to that of embodiment 15, distortion is reduced.

Although the full-range reproduction loudspeakers 1 and 3 are used in the embodiments described above, similar effects to those of the above embodiments can be obtained with such a configuration that high frequency reproduction loudspeakers are provided separately to be driven by high frequency components of the respective channels and low/medium frequency range reproduction loudspeakers are used instead of the full-range reproduction loudspeakers 1 and 3. Also the L channel and the R channel can be interchanged in the above embodiments.

As described above, in the composite loudspeaker apparatus of the invention, the low frequency range reproduction loudspeaker mounted in the second air chamber acts as a drone cone driven by the back pressure of the full-range reproduction loudspeaker for one channel mounted in the first air chamber in a frequency range higher than the drive signal of the low frequency component, and contributes to the enhancement of the reproduced sound pressure in the low frequency range and to smoothing of peaks and dips. In the low frequency range of the low frequency component, on the other hand, because the two loudspeakers are driven substantially in phase in the low frequency range, air in the first air chamber is not compressed and therefore the performance of the full-range reproduction loudspeakers or the medium/low frequency range reproduction loudspeakers is improved. Further, because the low frequency sound enhanced through resonance is radiated from the second air chamber, reproduced sound pressure characteristic in the low frequency range is enhanced.

Also because the third air chamber provided with the sound port, drone cone or resonance duct is installed following the second air chamber provided with the sound port or the drone cone, reproduced sound pressure characteristic in the low frequency range is further enhanced.

Also because the cabinet of the loudspeaker apparatus of the other channel is constituted of another cabinet provided with the sound port or the drone cone or the resonance duct, reproduced sound pressure characteristic in the low frequency range of that channel is enhanced, and difference in the reproduced sound pressure characteristic between the L and R channels is reduced, and the sound source locating capability is also improved.

Also because the cabinet of the loudspeaker apparatus for the other channel is constituted of the first air chamber provided with the sound port or the drone cone and the second air chamber provided with the sound port or the drone cone or the resonance duct, reproduced sound pressure characteristic in the low frequency range of that channel is further enhanced, difference in the reproduced sound pressure characteristic between the L and R channels, is further reduced, and the sound source locating capability is further improved.

Further with the method of driving the composite loudspeaker apparatus of the invention, because the low frequency range reproduction loudspeakers are driven only by the low frequency component, no peak or dip arises in the medium/high frequency range even when the drive signals for both loudspeakers become slightly out of phase.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A composite loudspeaker apparatus, comprising:

a cabinet including, a first air chamber and a second air chamber adjacent to said first air chamber;

a first loudspeaker, mounted in said first air chamber of said cabinet;

a second loudspeaker, mounted in said second air chamber of said cabinet, at a boundary of said first air chamber and said second air chamber;

means for driving said first loudspeaker with an entire frequency spectrum of one of a left and right channel audio signal; and means for driving said second loudspeaker with a synthesized audio signal, synthesized from the left and right channel audio signals, wherein said second air chamber includes a sound port, a drone cone or a resonance duct.

2. The composite loudspeaker apparatus of claim 1, wherein said cabinet includes a third air chamber, having a sound port, a drone cone or a resonance duct, adjacent to said second air chamber.

3. The composite loudspeaker apparatus of claim 1, wherein the signal component driving said second loudspeaker is in phase with the signal component driving said first loudspeaker.

4. The composite loudspeaker apparatus of claim 3, further comprising:

a low-pass filter for passing only low frequency components of the synthesized audio signal to said second loudspeaker.

5. The composite loudspeaker apparatus of claim 1, wherein said second loudspeaker is disposed to oppose a back side of said first loudspeaker.

6. A composite loudspeaker apparatus, comprising:

a first cabinet having a first chamber and a second air chamber, adjacent to said first air chamber;

a first loudspeaker, mounted in said first air chamber of said first cabinet;

a second loudspeaker, mounted in said second air chamber of said first cabinet, at a boundary of said first air chamber and said second air chamber;

means for driving said first loudspeaker with an entire frequency spectrum of one of a left and right channel audio signal;

synthesizing means for synthesizing the left and right channel audio signals to produce a synthesized audio signal;

means for driving said second loudspeaker with the synthesized audio signal generated by said synthesizing means;

a second cabinet;

a third loudspeaker, mounted in said second cabinet; and means for driving said third loudspeaker with an entire frequency spectrum of the other of the left and right channel audio signals, wherein said second air chamber includes a sound port, a drone cone or a resonance duct.

7. The composite loudspeaker apparatus of claim 6, wherein said first cabinet includes a third air chamber, having a sound port, a drone cone or a resonance duct, wherein said third air chamber is adjacent to said second air chamber.

8. The composite loudspeaker apparatus of claim 6, wherein the signal component driving said second loudspeaker is in phase with the signal component driving said first loudspeaker.

9. The composite loudspeaker apparatus claim 8, further comprising:

a low-pass filter for passing only low frequency components of the synthesized audio signal obtained from said synthesizing means to said second loudspeaker.

10. The composite loudspeaker apparatus of claim 6, wherein said second loudspeaker is mounted to oppose a back surface of said first loudspeaker.

11. The composite loudspeaker apparatus of claim 6, wherein said second cabinet includes a third air chamber and a fourth air chamber including a sound port, a drone cone or a resonance duct;

said third loudspeaker, being disposed in said third air chamber; and a fourth loudspeaker, disposed in said fourth air chamber.

12. The composite loudspeaker apparatus of claim 6, wherein said second cabinet includes a third air chamber having a sound port or a drone cone and with a fourth air chamber including a sound port, a drone cone or a resonance duct and said third loudspeaker being disposed in said third air chamber.

13. A method of driving a composite loudspeaker apparatus, comprising the steps of:

driving a loudspeaker for full-range reproduction, mounted in a first air chamber of a cabinet partitioned into at least two air chambers, with an entire frequency spectrum of one of a left and right channel audio signal; and driving a low frequency range reproduction loudspeaker, mounted in a second air chamber at a boundary of the first air chamber and the second air chamber including a sound port, a drone cone or a resonance duct with a low frequency component of a synthesized audio signal, synthesized from the left and right channel audio signals.

14. The method of claim 13, wherein the low frequency range reproduction loudspeaker is driven in phase with the full-range reproduction loudspeaker.

* * * * *